US006338648B1

(12) United States Patent
Miura et al.

(10) Patent No.: US 6,338,648 B1
(45) Date of Patent: Jan. 15, 2002

(54) ELECTRICAL CONNECTOR FOR FLEXIBLE PRINTED BOARD

(75) Inventors: Kazuto Miura; Taichiro Miyao, both of Kanagawa; Shinji Uchida, Tokyo, all of (JP)

(73) Assignee: J.S.T. Mfg. Co., LTD, Osaka (JP)

( * ) Notice: Subject to any disclaimer, the term of this patent is extended or adjusted under 35 U.S.C. 154(b) by 0 days.

(21) Appl. No.: 09/558,544

(22) Filed: Apr. 26, 2000

(30) Foreign Application Priority Data

Apr. 30, 1999 (JP) ..... 11-124566

(51) Int. Cl.[7] ..... H01R 13/15
(52) U.S. Cl. ..... 439/495; 439/260; 439/331
(58) Field of Search ..... 439/260, 259, 439/495, 492, 67, 331

(56) References Cited

U.S. PATENT DOCUMENTS 5,194,017 A * 3/1993 Consoli ..... 439/495
5,312,267 A * 5/1994 Matsuoka et al. ..... 439/331
5,354,214 A * 10/1994 Aso et al. ..... 439/495
5,695,359 A * 12/1997 Fujikura ..... 439/495
5,839,917 A * 11/1998 Takahashi et al. ..... 439/495
6,056,572 A * 5/2000 Matsumoto et al. ..... 439/495

FOREIGN PATENT DOCUMENTS

EP 0 696 090 A2 2/1996
EP 0 729 204 A2 8/1996

* cited by examiner

*Primary Examiner*—Hien Vu
(74) *Attorney, Agent, or Firm*—Rader, Fishman & Grauer, PLLC

(57) ABSTRACT

A connector includes a cover adapted to openably close an opening of a housing, and a locking mechanism for locking the cover in a closed position. The cover is provided with first metallic reinforcement means which is partially embedded in the cover during the molding thereof. Second metallic reinforcement means is fixed to the housing. The cover is locked in the closed position by bringing an engagement portion of the first reinforcement means into engagement with an engagement portion of the second reinforcement means.

38 Claims, 13 Drawing Sheets

ELECTRICAL CONNECTOR FOR FLEXIBLE PRINTED BOARD

CROSS REFERENCE TO RELATED APPLICATION

This application claims the benefit under 35 U.S.C. §119 of Japanese Patent Application No.11-124566 filed on Apr. 30, 1999, the abstract of disclosure of which is incorporated herein by reference.

BACKGROUND OF THE INVENTION

1. Field of the Invention

The present invention relates to an electrical connector for flexible printed board called FPC (Flexible Printed Circuit).

2. Description of Related Art

There has been known to the art the connector of this type which includes a synthetic-resin housing having an opening and contacts facing the opening, and a synthetic-resin cover which is pivotally movable to open/close the opening of the housing and which, at closed position, maintains the FPC pressed against the contacts.

The cover is integrally formed with a pair of resin projections, as support shafts, at opposite ends of one edge thereof. As born on pivotal support portions of the housing (or members retained by the housing), these support shafts permit the cover to pivot between an opened position and the closed position.

On the other hand, the cover is integrally formed with a pair of resin locking projections at opposite ends of the other edge thereof. The locking projections are brought into engagement with lock notches of the housing for establishing lock (see, for example, Japanese Utility Model Laid-Open Gazette No. 6-77186).

The aforesaid resin locking projections are relatively small in diameter and susceptible to deformation or breakage. In particular, repeated openings and closings of the cover involve disadvantages that the lock comes loose due to the deformed locking projection or fails due to the broken locking projection.

More recently, there has been a growing trend to reduce pitch between contacts or to increase multipolar contacts. This leads to the adoption of synthetic resin materials for the cover which have enough fluidity to ensure dimensional accuracy. Unfortunately, the synthetic resin materials of this type tend to decrease in toughness, resulting in higher incidence of locking projection breakage.

SUMMARY OF THE INVENTION

The invention seeks to provide an electrical connector for flexible printed board which features positive locking of the cover and a locking mechanism rigid enough to withstand repeated openings and closings of the cover.

In accordance with a preferred embodiment of the invention, this object is accomplished in an electrical connector for flexible printed board which comprises a synthetic-resin housing including an opening and contacts facing the opening; a synthetic-resin cover which is rotatable around a predetermined axis between an opened position and a closed position to press a flexible printed board against the contacts; a locking mechanism for locking the cover in the closed position; first metallic reinforcement means which is partially embedded in the cover during the molding of the cover; and second metallic reinforcement means fixed to the housing, the connector characterized in that the locking mechanism is respectively disposed in the first and the second reinforcement means and includes a first and a second engagement portions which releasably engage with each other.

According to the embodiment of the invention, the locking of the cover is ensured because the cover is locked by means of the engagement between the rigid metallic members. Further, the locking mechanism withstands the repeated openings and closings of the cover. In addition, the first reinforcement means has high adhesion to the cover because the first reinforcement means is inserted in the cover during the molding thereof.

BRIEF DESCRIPTION OF THE DRAWINGS

FIG. 3A is a sectional view taken on the line III—III in FIG. 2 whereas

DETAILED DESCRIPTION OF THE PREFERRED EMBODIMENTS

Now, preferred embodiments of the invention will be described with reference to the accompanying drawings.

Figure 1:
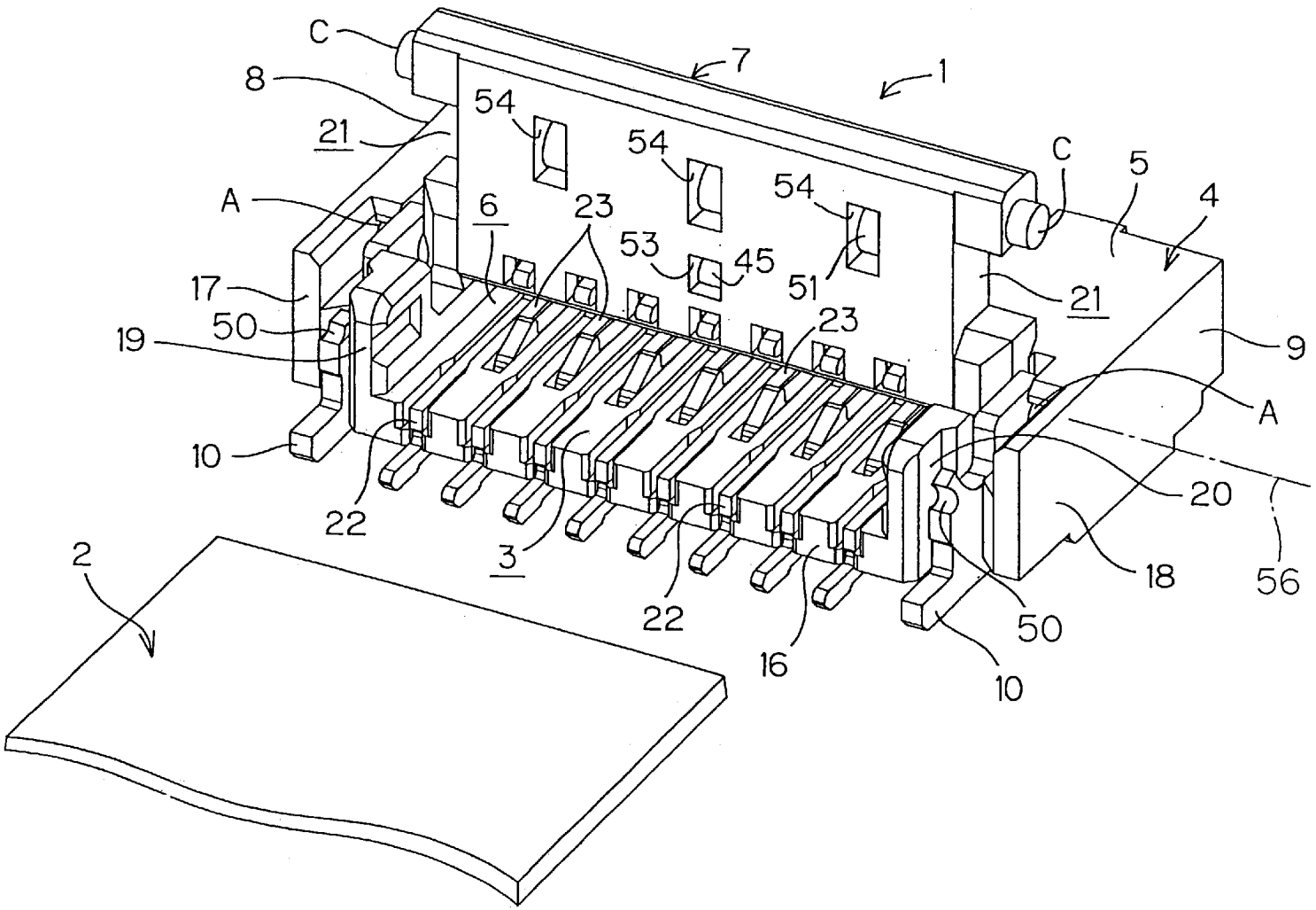
FIG. 1 is an exploded perspective view showing a FPC connector according to one embodiment of the invention and an FPC.
Figure 2:
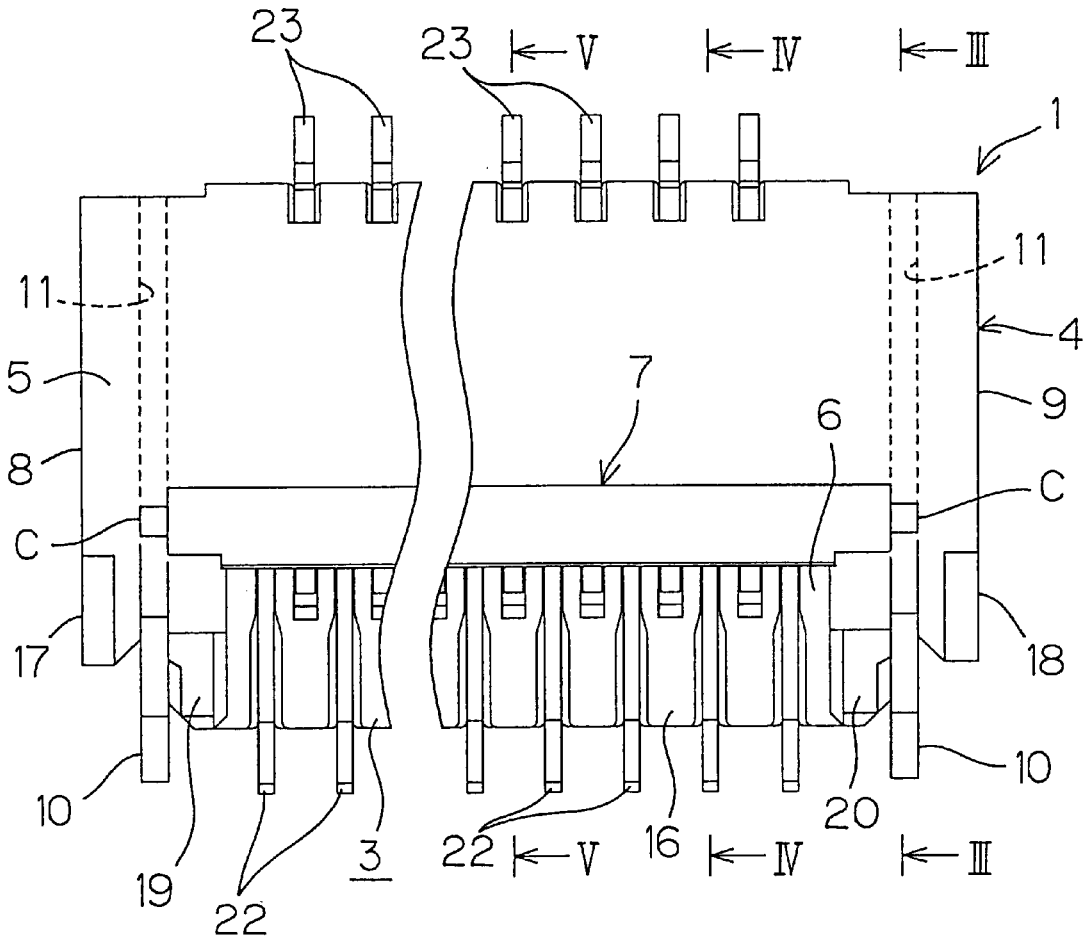
FIG. 2 is a partially cutaway plan view showing the connector with a cover opened.

Referring to FIGS. 1 and 2, an electrical connector for flexible printed board 1 (hereinafter, simply referred to as "connector 1") according to one embodiment of the invention includes a synthetic-resin housing 4 defining an insertion space 3 where a flexible printed board 2 (hereinafter, simply referred to as "FPC 2") is inserted from front or removed. A front half portion of the housing 4 upwardly opens via an opening 6 of a top plate 5 of the housing 4 and is provided with a cover 7, a molded article of synthetic resin, which is pivotally movable to open or close the opening 6.

Figure 6:
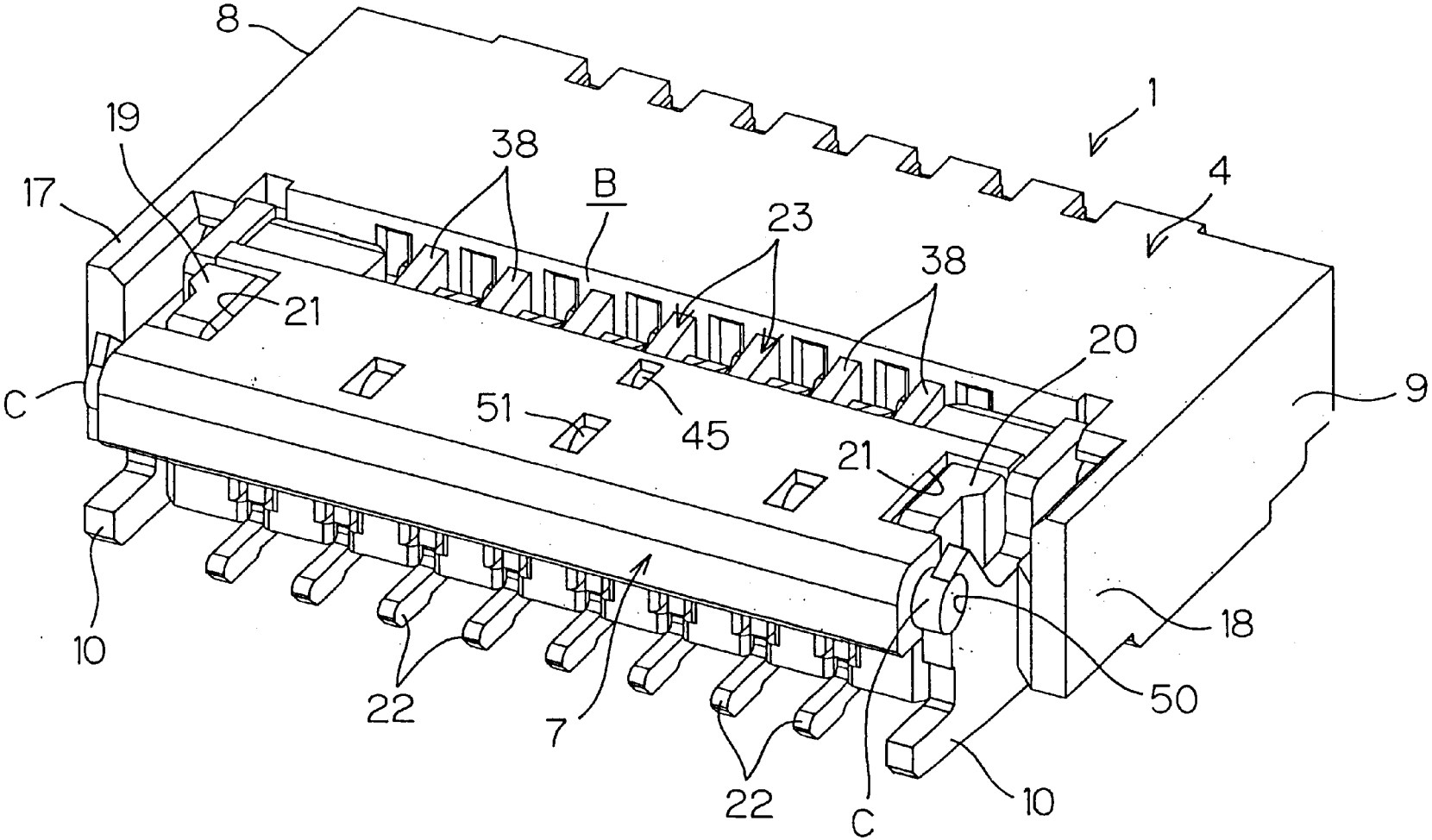
FIG. 6 is a perspective view showing the connector with the cover almost closed.

Indicated at 51 is a metallic wire as a first reinforcement member embedded in the cover 7. Opposite ends of the wire 51 include a pair of locking projections C, as a first engagement portion. As shown in FIGS. 3B and 6, each locking projection C locks in a lock notch 50, as a second engagement portion, of a corresponding reinforcement tab 10 formed of a metal sheet, as a second reinforcement member fixed to the housing 4, thereby locking the cover 7 in closed position. The locking projections C of the wire 51 and the lock notches 50 constitute a locking mechanism.

Indicated at 45 is a metallic wire, as a third reinforcement member, embedded in the cover 7. Opposite ends of the wire 45 include a pair of pivot shafts A. Openings 53, 54 are defined in the cover 7 for exposing respective parts of the corresponding wires 45, 51 as exposure portions 58, 59 to the outside of the cover 7.

Opposite side plates 8, 9 of the housing 4 define lateral sides of the insertion space 3. A pair of fixing holes 11 open to respective front end faces of the side plates 8, 9 (not shown in FIG. 1 but illustrated in FIG. 2 and FIG. 3A which is a sectional view taken on the line III—III in FIG. 2). The fixing holes 11 respectively receive from front and fix the reinforcement tabs 10 which support the pair of pivot shafts A projecting laterally of the cover 7, respectively.

Figure 3A:
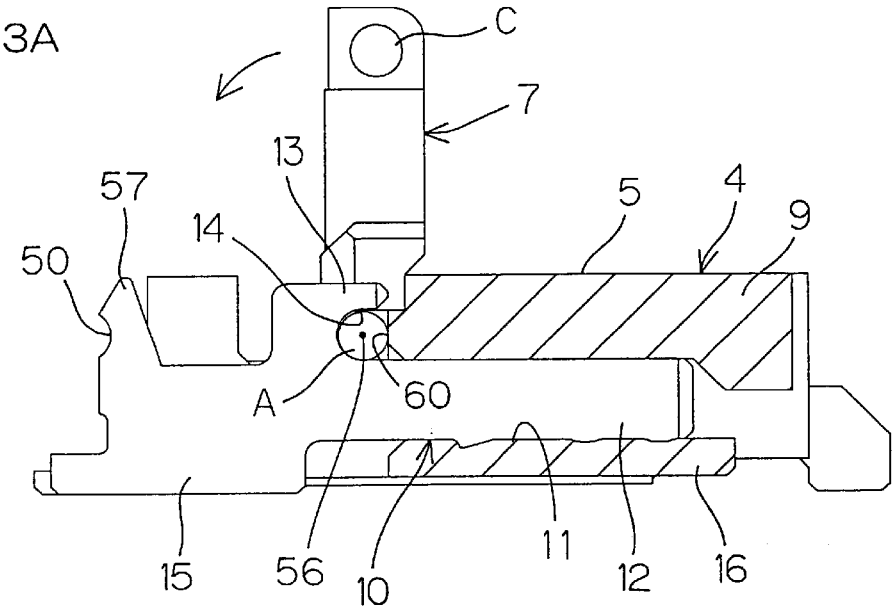
Figure 3B:
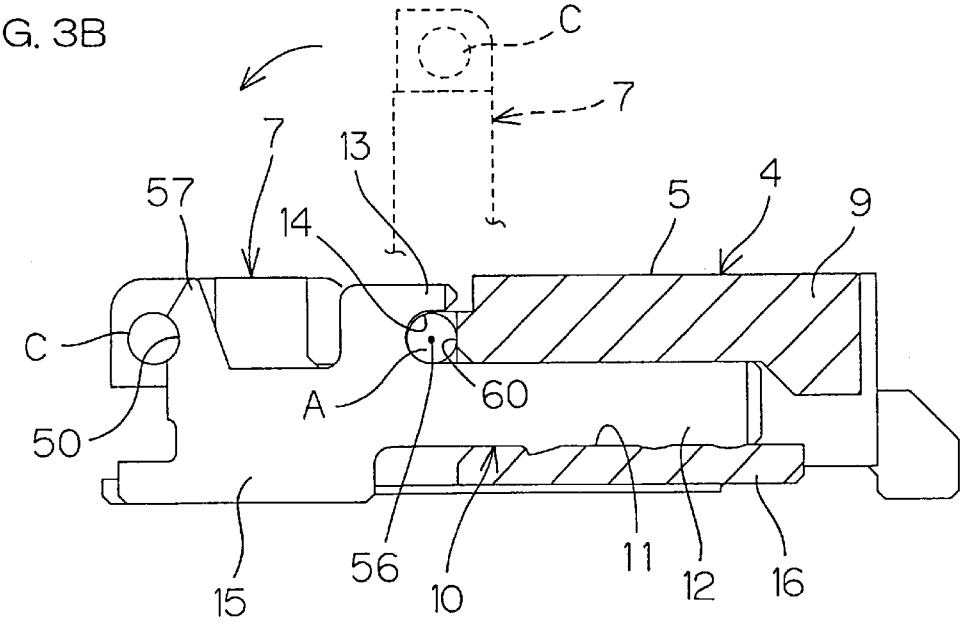
FIG. 3B shows the cover of FIG. 3A in closed position, FIGS. 3A and 3B omitting the hatching of an area representing the section of a reinforcement tab.

Referring to FIGS. 3A and 3B, the reinforcement tab 10 includes a main body 12, a pivotal support portion 14 for supporting the pivot shaft A and a hook-shaped fixing portion 15 soldered to a substrate surface. The main body 12 is inserted into the fixing hole 11 from front so as to be fixed via a locking projection. The pivotal support portion 14 is comprised of a U-shaped notch defined by an extension piece 13 extending upward from a front end of the main body 12. The pivotal support portion 14 pivotally supports the corresponding pivot shaft A. The fixing portion 15 extends downward from the front end of the main body 12.

An extension piece 57 also extends upward from upper front end of the main body 12. The aforesaid lock notch 50 is formed in a fore-end face of the extension piece 57, serving to lock the cover 7 in the closed position through engagement with the locking projection C. An abutting portion 60 of the housing 4 is abutted against the pivot shaft A received by the U-shaped notch as the pivotal support portion 14, thereby retaining the pivot shaft A in the U-shaped notch.

Turning back to FIGS. 1 and 2, the side plates 8, 9 are formed with extensions 17, 18 extended forward, respectively. The extensions 17, 18 have a smaller thickness than the side plates 8, 9. The extensions 17, 18 are located laterally outside of the neighboring fixing holes 11, extending to some point of the lateral sides of the opening 6. Guide walls 19, 20 upstand from opposite side edges of a front portion of a bottom plate 16 of the housing 4. When the cover 7 is closed, the guide walls 19, 20 are received by corresponding U-shaped gaps 21 defined at lateral edges of the cover 7, thereby restricting the lateral movement of the cover 7.

Within the insertion space 3 of the housing 4, a plurality of first and second fork-shaped contacts 22, 23 are arranged in two rows in a zigzag fashion.

Figure 4:
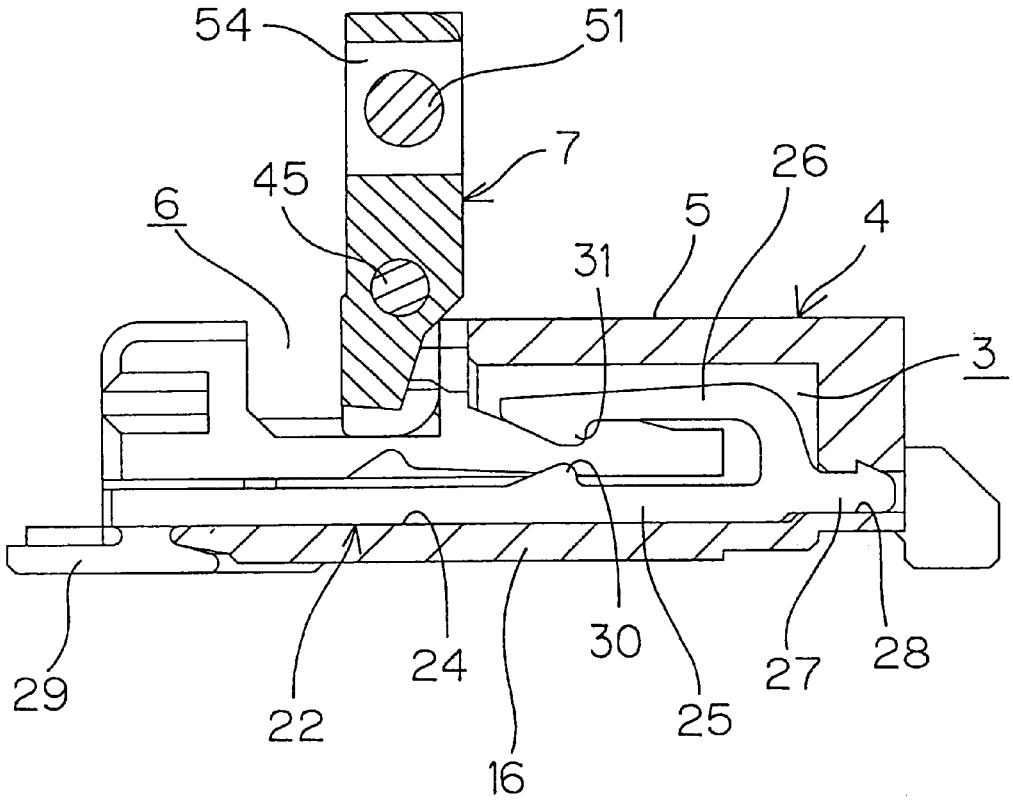
FIG. 4 is a sectional view taken on the line IV—IV in FIG. 2 and omits the hatching of an area representing the section of a first contact.

Referring to FIGS. 1, 2 and 4 which is a sectional view taken on the line IV—IV in FIG. 2, the first contact 22 is comprised of a metallic member which is inserted, from front, into the insertion space 3 of the housing 4 and fixed. As seen in FIG. 4, the first contact 22 includes a fixing piece 25 inserted, from front, into a receiving groove 24 defined in an upper surface of the bottom plate 16 of the housing 4, and a resilient piece 26 located above the fixing piece 25 in a rear half portion of the insertion space 3.

A locking piece 27 with a locking projection extends rearwardly from an interconnection between the fixing piece 25 and the resilient piece 26. The locking piece 27 is inserted into a fixing hole 28 of the housing 4 and fixed. The fixing piece 25 is provided with a lead portion 29 of inverted T-form at its front end. The lead portion 29 is soldered to the substrate surface on which the present connector 4 is mounted, while engaging a front edge of the bottom plate 16 of the housing 4 for preventing the upward dislocation of the fixing piece 25. Chevron-shaped projections 30, 31 are formed at the fixing piece 25 and the resilient piece 26 in opposed relation, for clamping the inserted FPC 2 therebetween thereby to ensure a contact pressure on the FPC 2.

Figure 5:
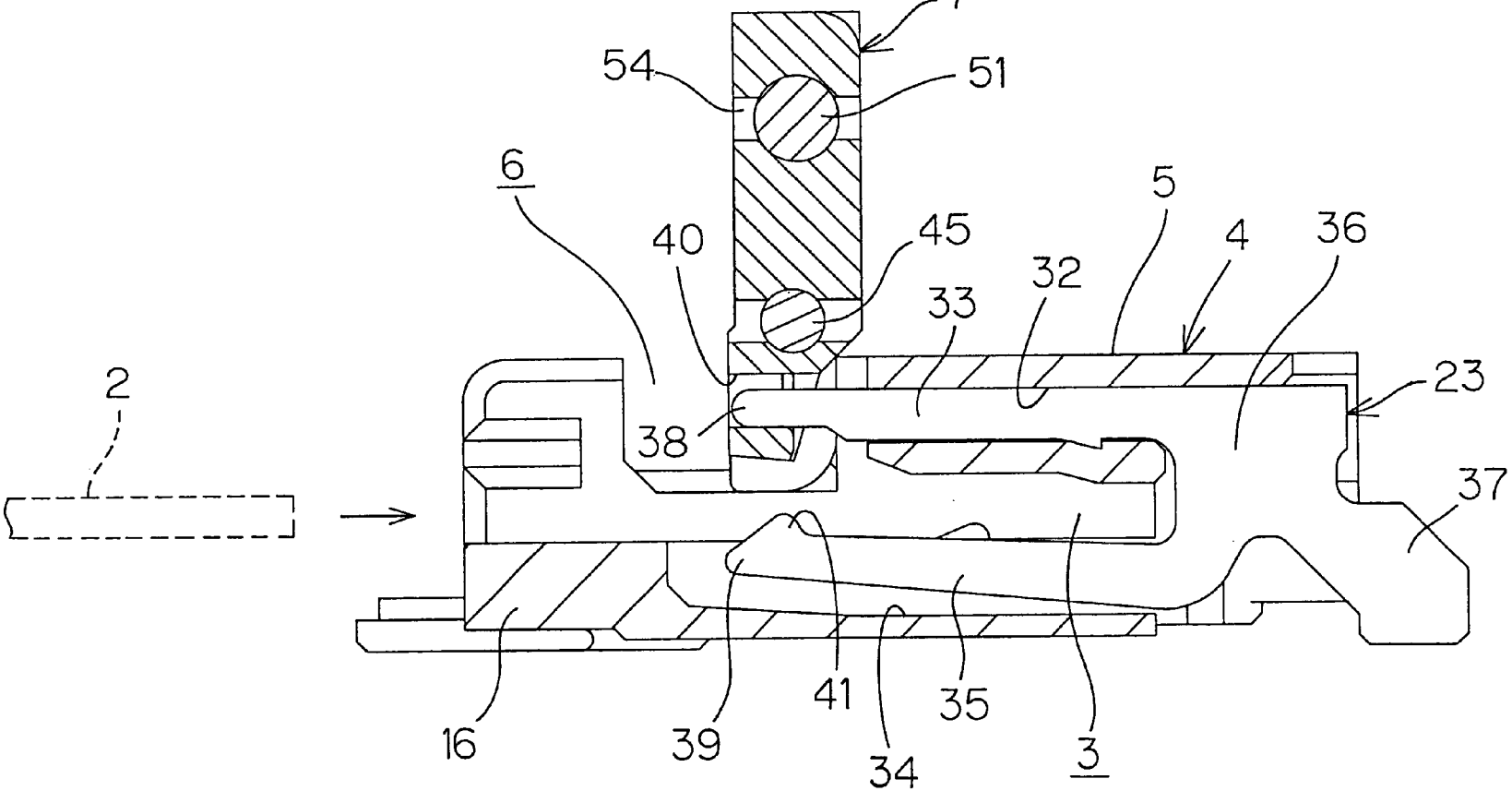
FIG. 5 is a sectional view taken on the line V—V in FIG. 2 and omits the hatching of an area representing the section of a second contact.

Referring to FIGS. 1, 2 and 5 which is a sectional view taken on the line V—V in FIG. 2, the second contact 23 is comprised of a metallic member which is inserted, from rear, into the insertion space 3 of the housing 4 and fixed. As seen in FIG. 5, the second contact 23 includes a fixing piece 33 with a locking projection, a resilient piece 35 located below the fixing piece 33, a main body 36 and a lead portion 37.

The fixing piece 33 is inserted, from rear, into a fixing hole 32 at an upper part of the housing 4 and fixed. The resilient piece 35 is inserted, from rear, into a receiving groove 34 defined in the upper surface of the bottom plate 16 of the housing 4. The main body 36 interconnects rear ends of the fixing piece 33 and the resilient piece 35. The lead portion 37 extends rearward from the main body 36 in an obliquely downward direction and is soldered to the substrate surface.

Figure 9:
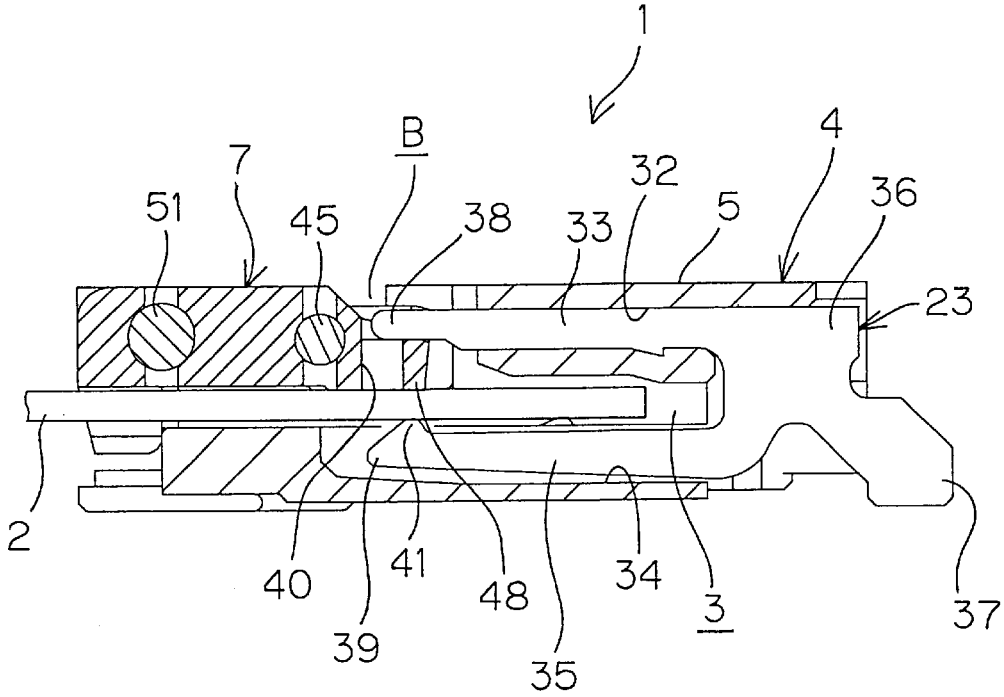
FIG. 9 is a sectional view showing the connector with the FPC connected and corresponding to FIG. 5.

Respective front ends 38, 39 of the fixing piece 33 and the resilient piece 35 reach a midportion of the housing 4 with respect to the anteroposterior direction thereof. The front end 38 of the fixing piece 33 enters an open hole 40 of the cover 7 when the cover 7 of FIG. 5 is closed. Further, the front end 38 exposes itself to the outside thereabove via an open area B defined along an edge of the cover 7 when the cover 7 is closed, as shown in FIGS. 6 and 9. Thus, the continuity test may be readily performed by bringing a continuity test probe into contact with the front end 38 of the fixing piece 33 of the second contact 23 via the open area B of the closed cover 7.

On the other hand, the front end 39 of the resilient piece 35 is formed with an upward chevron-shaped projection 41 for ensuring the contact pressure on the FPC 2.

Figure 7:
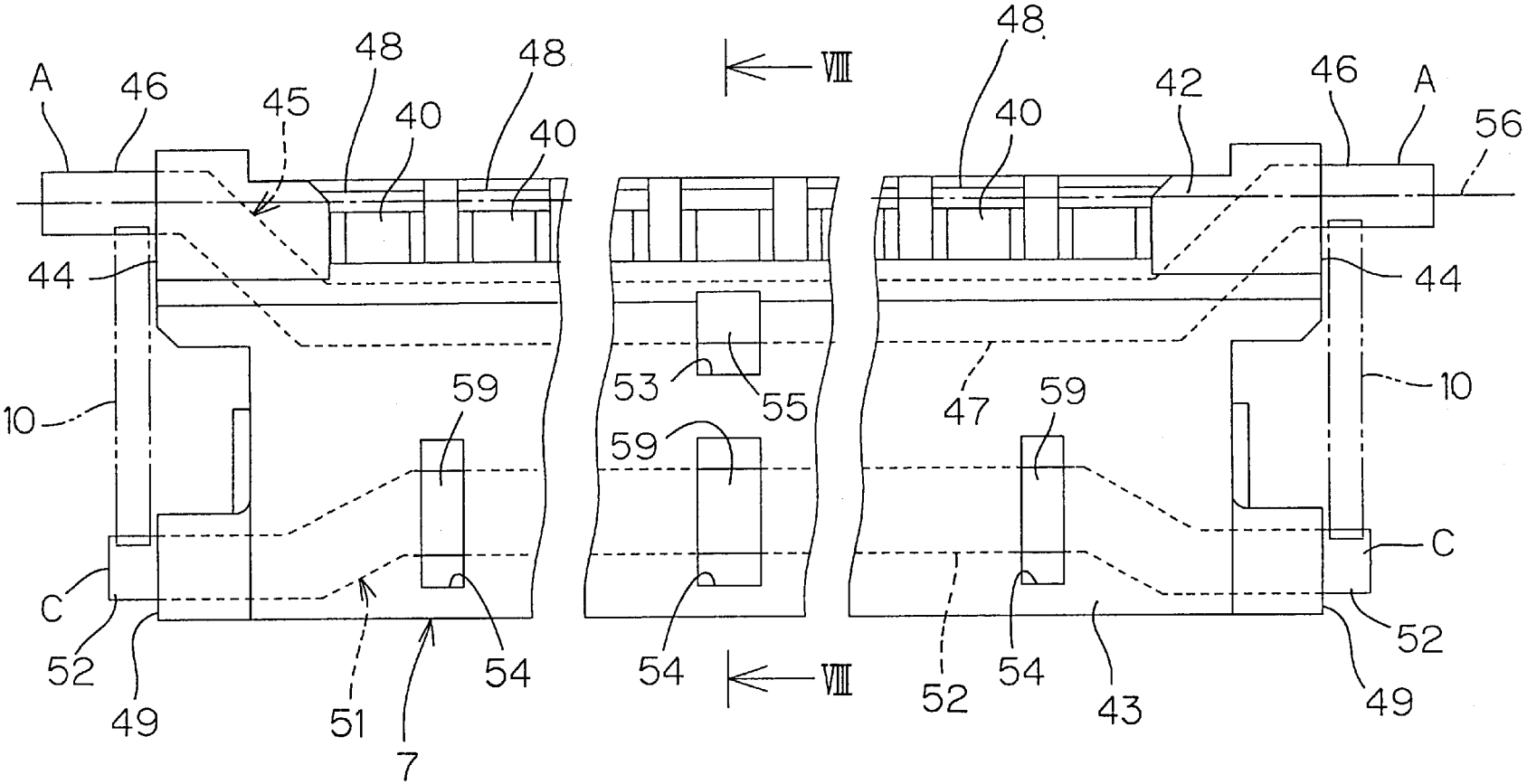
FIG. 7 is a partially cutaway plan view showing the cover.

Referring to FIGS. 1 and 7 which is a plan view of the cover, the cover 7 is of a rectangular plate, having first and second edges 42, 43 in opposed relation. The aforesaid pair of pivot shafts A project from opposite lateral ends 44, 44 of the first edge 42, respectively.

The pivot shaft pair A comprise exposed opposite ends 46, 46 of the metallic wire 45 which is embedded in the cover 7 during the molding thereof. The whole body of the wire 45 takes on a crank form, an intermediate portion 47 of which extends parallel to the first edge 42 as spaced a distance therefrom.

Along the first edge 42 of the cover 7, a plurality of open holes 40 are arranged in side-by-side relation for permitting the retractable entrance of the front ends 38 of the second contacts 23, as shown in FIG. 5. In FIG. 7, a portion closer to the first edge 42 than the open holes 40 defines a pressing portion 48.

When the cover 7 is moved to the closed position, the pressing portion 48 presses the FPC 2 against the resilient piece 35 as clamped between the FPC 2 on the resilient piece 35 of the second contact 23 and the fixing piece 33, as shown in FIG. 9.

Turning back to FIG. 7, the pair of locking projections C project from opposite lateral ends 49, 49 of the second edge 43 of the cover 7, respectively, so as to engage the corresponding lock notches 50 of the reinforcement tabs 10. When the cover 7 is closed, the locking projections C engage the lock notches 50 thereby to lock the cover 7 in the closed position. An arrangement is made such that when the cover 7 is closed, the pair of reinforcement tabs 10, indicated by the two-dot chain line in FIG. 7, couple the respective ends (equivalent to the pivot shafts A) of the wire member 45 with the corresponding ends (equivalent to the locking projections C) of the wire 51 as a lock shaft, for forming a rectangular closed loop of the wire 45, wire 51 and reinforcement tab pair 10, 10.

The locking projection pair C comprise exposed opposite ends 52, 52 of the metallic wire 51 which is embedded in the cover 7 during the molding thereof. The whole body of the wire 51 take on a crank form, an intermediate portion 52 of which extends parallel to the second edge 43 as spaced a distance therefrom.

Figure 8:
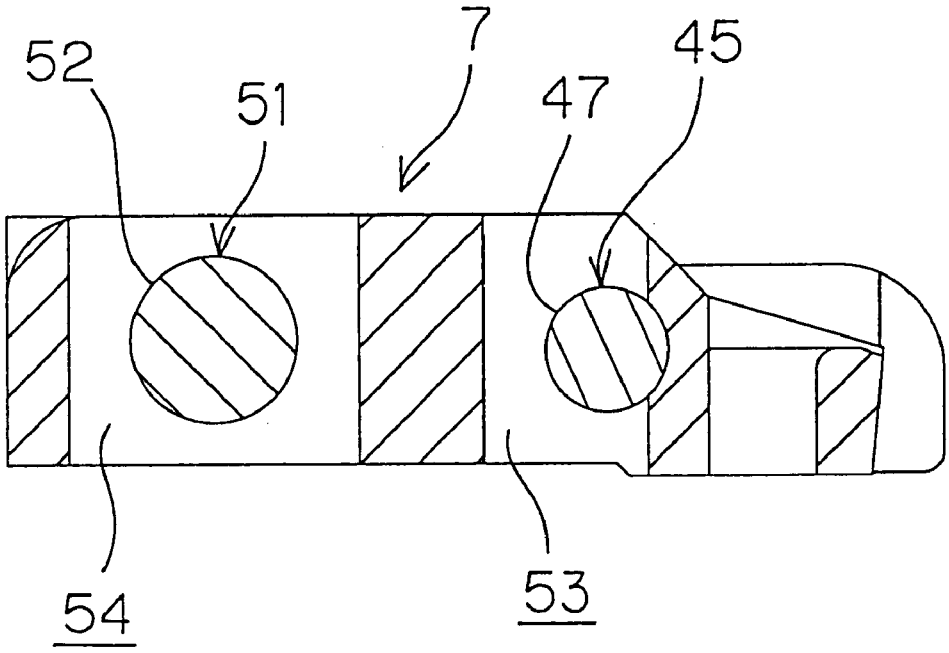
FIG. 8 is a sectional view taken on the line VIII—VIII in FIG. 7.

Referring to FIGS. 7 and 8 which is a sectional view taken on the line VIII—VIII in FIG. 7, there are provided one or more openings 53 for exposing the wire 45 whereas one or more openings 54 are provided for exposing the intermediate portion of the wire 51. These openings 53, 54 play the following role. In order to insert the metallic wires 45, 51 in an article being molded for producing the cover 7 with the wires embedded therein, the metallic wires 45, 51 must be supported in a given position within the molding die. The openings 53, 54 permit wide support pins (insert pins) to be placed in the molding die at places in correspondence thereto. Thus, the wires 53, 54 may be stably supported within the molding die. As a result, the molded article has high positional accuracies for the pivot shafts A and locking projections C which are comprised of the opposite ends of the wires 45, 51, respectively.

The present embodiment is designed to lock the cover 7 by bringing the locking projections C, being the ends of the metallic wire 51, into engagement with the lock notches 50 of the metallic reinforcement tabs 10. Therefore, the cover is positively locked. It is also ensured that the locking mechanism withstands the repeated openings and closings of the cover 7. Since the wire 51 as the lock shaft is inserted in the cover 7 during the molding thereof, high adhesion is accomplished between the lock shaft and the cover 7.

In addition, since the reinforcement tabs 10 for reinforcing the housing 4 are formed with the lock notches 50, the structure is simplified as compared with a case where a separate member with the lock notch is added.

Furthermore, the cover 7 is improved in the substantial strength because the pivot shafts A are formed of metal and supported by the pivotal support portions 14 of the metallic reinforcement tabs 10. The mechanism for supporting the cover 7 in the pivotal movement is subject to counterforce of the lock. If the mechanism for supporting the pivotal movement should be embodied in resin members engaged each other, the members may suffer relatively low strength. On this account, the present embodiment employs the metallic members in engaged relation as the mechanism for supporting the pivotal movement so as to achieve the increased strength.

Particularly when closed, the resin cover 7 is reinforced by the metallic members 45, 10, 51, 10 forming the rectangular closed loop, as shown in FIG. 7. This provides the more positive locking of the cover 7.

Figure 10:
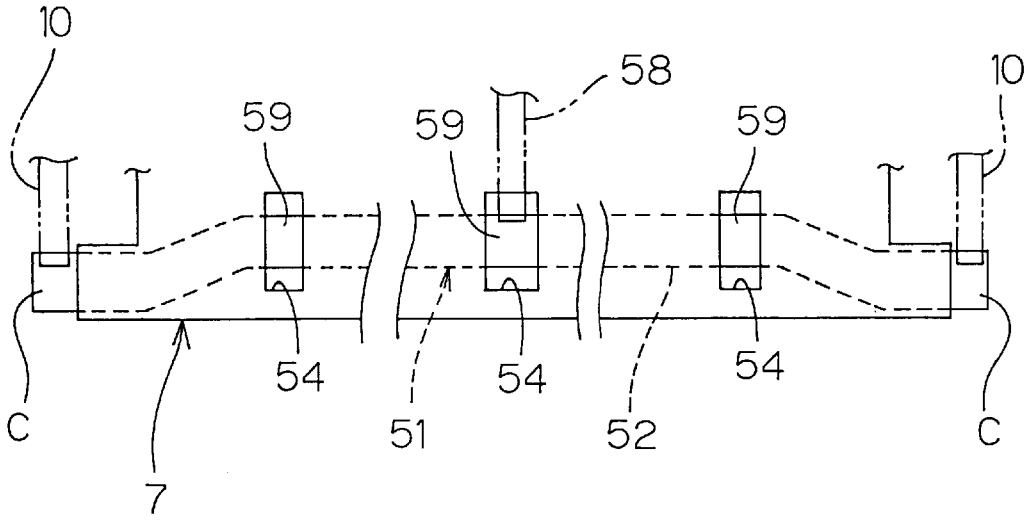
FIG. 10 is a schematic diagram showing a combination of a wire member and reinforcement tabs according to another embodiment of the invention.

It is noted that the present invention is not limited to the above embodiment. For instance, in addition to the reinforcement tabs 10, 10 adapted to engage the opposite ends of the wire 51 as the lock shaft, a reinforcement tab 58 may be fixed to the housing 4 so as to engage at least one exposure portion 59 of the axially intermediate portion of the wire 51, as shown in FIG. 10. This arrangement is effective to prevent the widthwise deflection of the intermediate portion of the cover 7, which has particularly a great width for accommodating a great number of contacts. Hence, the more positive locking of the cover is accomplished. Incidentally, there may be provided a plurality of reinforcement tabs 58 for the intermediate portion.

Figure 11A:
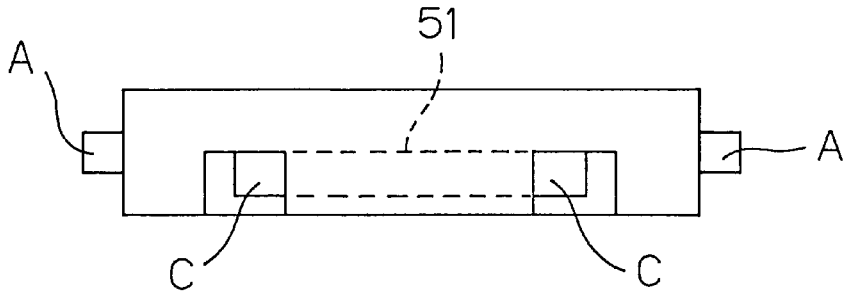
FIGS. 11A and 11B are a schematic front view and a schematic bottom view showing a cover according to yet another embodiment of the invention.
Figure 11B:
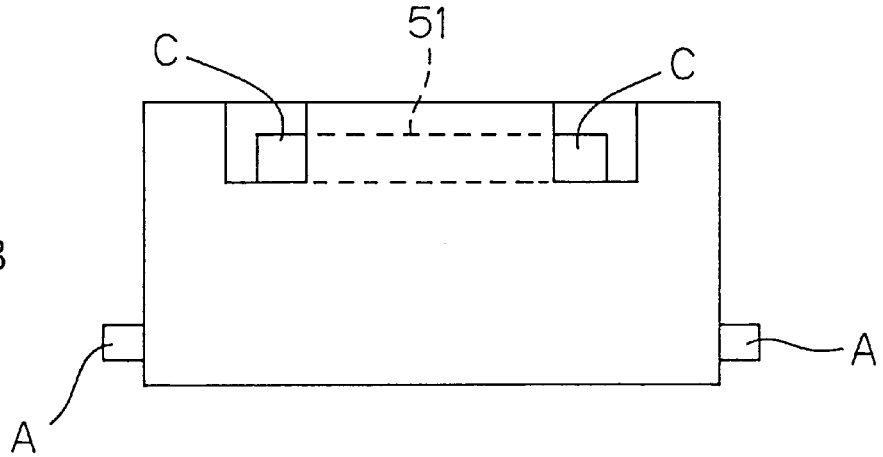

As shown in FIGS. 11A and 11B, an alternative arrangement may be made wherein the wire 51 as the lock shaft extends in a length such as not to project beyond the lateral sides of the cover 7 and exposes itself to the outside therebelow via a pair of recesses defined in a lower surface of the cover 7. This arrangement is effective to protect the wire 51 because the wire 51 does not project to the outside and is free from unwanted external force.

Figure 12:
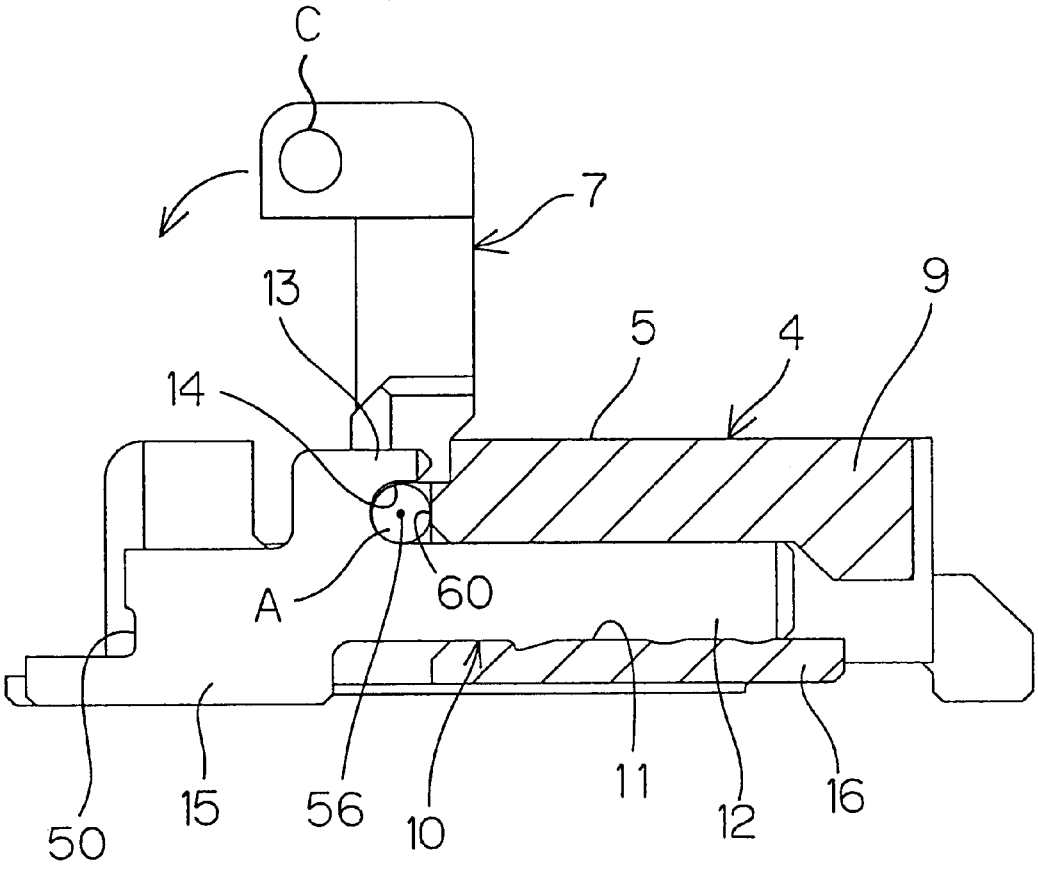
FIG. 12 is a schematic sectional view showing a connector according to still another embodiment of the invention.

In the embodiment of FIG. 3A, the lock notch 50 is formed at the extension piece 57 of the reinforcement tab 10 but may not necessarily be formed in this manner. As shown in FIG. 12, the lock notch 50 may be formed in a front end face of the main body 12.

Figure 13:
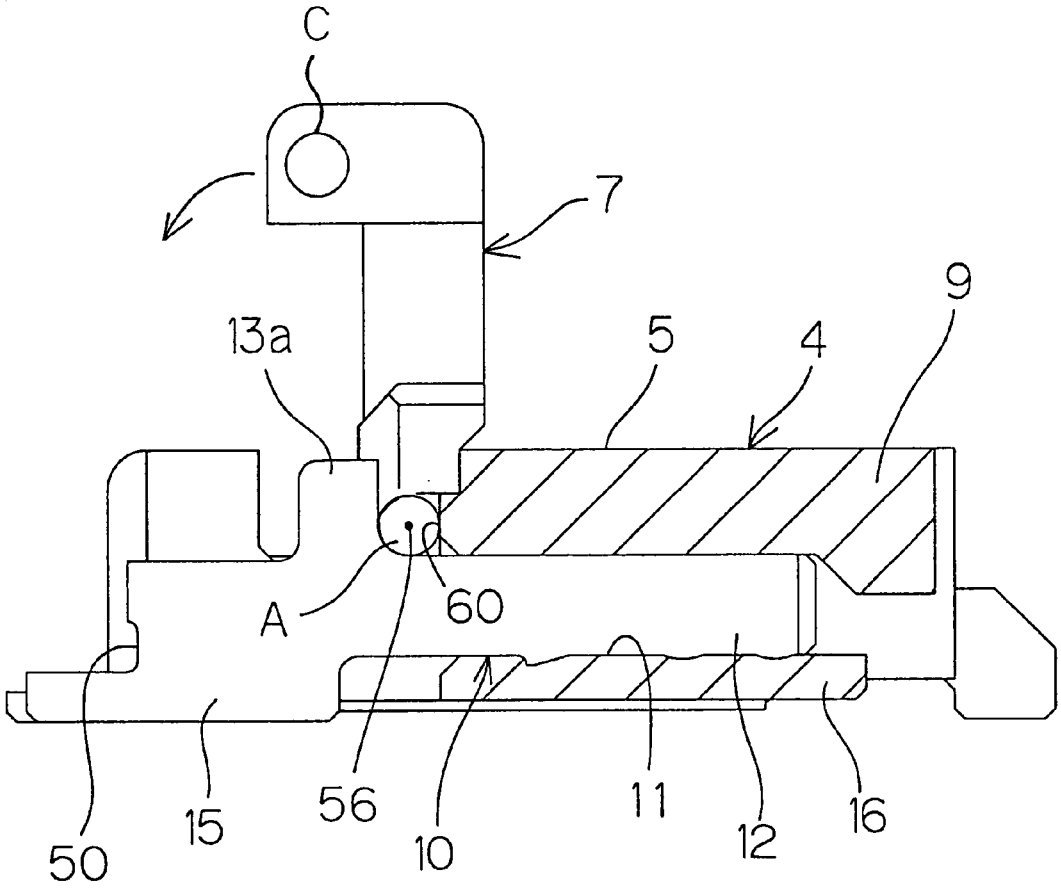
FIG. 13 is a schematic sectional view showing a connector according to yet another embodiment of the invention.

As shown in FIG. 13, the substantially L-shaped extension piece 13 of the reinforcement tab 10 may be replaced by a straight extension piece 13*a* extending substantially orthogonally from the main body 12. In this case, the extension piece 13*a* serves to prevent the corresponding pivot shaft A from being dislocated from place in a direction to draw out the FPC 2(leftward as seen in the figure).

In the above embodiments, the first engagement portion is embodied in the locking projection C while the second engagement portion is embodied in the lock notch 50. However, the first and second engagement portions are not limited to this arrangement but any arrangement permitting the both engagement portions to engage in projection-recess relation is usable. For instance, an end of the first reinforcement member may be bent into a semi-circular arch to define a recess as the first engagement portion, which may be engaged with a projection as the second engagement portion of the housing.

The locking projection C as the first engagement portion may have the whole periphery thereof exposed, as illustrated in the above embodiments, or otherwise have a half of the periphery thereof exposed with the other half embedded. In a case where the first reinforcement member is of a circular form in section, for example, the reinforcement member may have a portion thereof exposed as a semi-cylindrical projection extended along the surface of the cover, the semi-cylindrical projection adapted to engage the lock notch.

The first reinforcement member may be round or square in section. In the case of the square section, the first reinforcement member may have further increased adhesion to the cover.

The present invention is also applicable to a slide-type connector for FPC wherein the lock may be established by the engagement between metallic members of the slider and reinforcement member used in combination. Other various changes and modifications are possible within the scope of the invention.

What is claimed is:

1. An electrical connector for flexible printed board comprising:

a synthetic-resin housing including an opening and contacts facing the opening, a synthetic-resin cover which is rotatable around a predetermined axis between an opened position and a closed position to press a flexible printed board against the contacts, a locking mechanism that locks the cover in the closed position, a first metallic reinforcement which is partially embedded in the cover during the molding of the cover, and which includes a pair of opposite ends which are exposed from the cover, and a second metallic reinforcement fixed to the housing and having a second engagement portion at one end thereon, the first and second reinforcements constituting the locking mechanism, and the locking mechanism including a first engagement portion constituted by the pair of opposed ends of the first reinforcement, and the second engagement portion which releasably engages with the first engagement portion.

2. A connector according to claim 1, wherein the second reinforcement comprises a pair of reinforcing plates, each reinforcing plate including:

a main body fixed to the housing; and the second engagement portion which engages the first engagement portion provided at each of the opposite ends of the first reinforcement.

3. A connector according to claim 1, further comprising a pair of pivot shafts provided respectively at a pair of lateral side portions of the cover and being aligned with the axis, the second reinforcement including support portions for supporting the pivot shafts.

4. A connector according to claim 1, further comprising a third reinforcement which comprises a metallic wire partially embedded in the cover during the molding thereof.

5. A connector according to claim 4, wherein the pair of pivot shafts are respectively provided at a pair of opposite ends of the third reinforcement.

6. A connector according to claim 1, wherein the first reinforcement further includes at least one exposure portion exposed from the cover at an intermediate portion between a pair of lateral side portions thereof, wherein the second reinforcement comprises at least three reinforcing plates which are respectively disposed in correspondence with the pair of opposite ends and at least one exposure portion, and wherein each of the reinforcing plates has a main body fixed to the housing and the second engagement portion.

7. A connector according to claim 1, further comprising a third metallic reinforcement being partially embedded in the cover, and wherein the first, second and third reinforcements form a closed loop when the cover is in the closed position.

8. A connector according to claim 1, further comprising a third metallic reinforcement being partially embedded in the cover, wherein a pair of opposite ends of the third reinforcement are respectively disposed at a pair of lateral side portions of the cover and comprise a pair of pivot shafts aligned with the axis, wherein the pair of opposite ends of the first reinforcement are respectively exposed from corresponding lateral side portions of the cover, and wherein the second reinforcement includes a pair of reinforcing plates, each of the reinforcing plates including the second engagement portion to engage the corresponding first engagement portion, and a support portion for supporting a corresponding pivot shaft.

9. A connector according to claim 8, wherein when the cover is in the closed position, the pair of opposite ends of the first reinforcement are coupled with the pair of opposite ends of the third reinforcement by the corresponding reinforcing plates whereby a substantially rectangular closed loop is formed by the first and third reinforcement and the pair of reinforcing plates.

10. A connector according to claim 1, further comprising a pair of pivot shafts provided at a pair of lateral side portions of the cover as aligned with the axis, wherein the second reinforcement comprises a pair of reinforcement plates, wherein each of the reinforcing plates includes a main body fixed to the housing and a substantially L-shaped extension piece extended from the main body, and wherein the main body and the substantially L-shaped extension piece define a notch for supporting the corresponding pivot shaft of the cover.

11. A connector according to claim 1, further comprising a pair of pivot shafts respectively provided at a pair of lateral side portions of the cover as aligned with the axis, wherein the second reinforcement comprises a pair of reinforcement plates, and wherein each of the reinforcing plates includes a main body fixed to the housing and a straight extension piece substantially orthogonally extending from the main body, the straight extension piece preventing the corresponding pivot shaft of the cover from being dislocated in a direction corresponding to drawing out the flexible board from said housing.

12. A connector according to claim 1, wherein the first reinforcement comprises a wire.

13. A connector according to claim 1, which further comprises a third reinforcement, partially embedded in the cover, and which comprises a wire.

14. An electrical connector for flexible printed board comprising:

a synthetic-resin housing including an opening and contacts facing the opening, a synthetic-resin cover which is rotatable around a predetermined axis between an opened position and a closed position to press a flexible printed board against the contacts, a first metallic reinforcement which is partially embedded in the cover during the molding of the cover, a second metallic reinforcement means fixed to the housing, and a pair of pivot shafts provided respectively at a pair of lateral side portions of the cover and being aligned with the axis, the second reinforcement including a support portion that supports a corresponding pivot shaft, the first and second reinforcements constituting a locking mechanism, that locks the cover in the closed position, and that includes a first and a second engagement portion at opposite ends thereon which releasably engage with each other.

15. A connector according to claim 14, wherein the first reinforcement includes a pair of opposite ends which are exposed from the cover and each of which comprises the first engagement portion.

16. A connector according to claim 15, wherein the second reinforcement comprises a pair of reinforcing plates, each reinforcing plate including:

a main body fixed to the housing; and the second engagement portion which engages the first engagement portion provided at each of the opposite ends of the first reinforcement.

17. A connector according to claim 14, further comprising a third reinforcement which comprises a metallic wire partially embedded in the cover during the molding thereof.

18. A connector according to claim 17, wherein the pair of pivot shafts are respectively provided at a pair of opposite ends of the third reinforcement.

19. A connector according to claim 15, wherein the first reinforcement further includes at least one exposure portion exposed from the cover at an intermediate portion between a pair of lateral side portions thereof, wherein the second reinforcement comprises at least three reinforcing plates which are respectively disposed in correspondence with the pair of opposite ends and at least one exposure portion, and wherein each of the reinforcing plates has a main body fixed to the housing and the second engagement portion.

20. A connector according to claim 14, further comprising a third metallic reinforcement being partially embedded in the cover, and wherein the first, second and third reinforcements form a closed loop when the cover is in the closed position.

21. A connector according to claim 14, further comprising a third metallic reinforcement being partially embedded in the cover, wherein a pair of opposite ends of the third reinforcement are respectively disposed at a pair of lateral side portions of the cover and comprise the pair of pivot shafts aligned with the axis, wherein a pair of opposite ends of the first reinforcement are respectively exposed from corresponding lateral side portions of the cover, and wherein the second reinforcement includes a pair of reinforcing plates, each of the reinforcing plates including the second engagement portion to engage the corresponding first engagement portion, and a support portion for supporting a corresponding pivot shaft.

22. A connector according to claim 21, wherein when the cover is in the closed position, the pair of opposite ends of the first reinforcement are coupled with the pair of opposite ends of the third reinforcement by the corresponding reinforcing plates whereby a substantially rectangular closed loop is formed by the first and third reinforcement and the pair of reinforcing plates.

23. A connector according to claim 14, wherein the second reinforcement comprises a pair of reinforcement plates, wherein each of the reinforcing plates includes a main body fixed to the housing and a substantially L-shaped extension piece extended from the main body, and wherein the main body and the substantially L-shaped extension piece define a notch for supporting the corresponding pivot shaft of the cover.

24. A connector according to claim 1, wherein the second reinforcement comprises a pair of reinforcement plates, and wherein each of the reinforcing plates includes a main body fixed to the housing and a straight extension piece substantially orthogonally extending from the main body, the straight extension piece preventing the corresponding pivot shaft of the cover from being dislocated in a direction corresponding to drawing out the flexible board from said housing.

25. A connector according to claim 14, wherein the first reinforcement comprises a wire.

26. A connector according to claim 14, which further comprises a third reinforcement, partially embedded in the cover, and which comprises a wire.

27. An electrical connector for flexible printed board comprising;

a synthetic-resin housing including an opening and contacts facing the opening, a synthetic-resin cover which is rotatable around a predetermined axis between an opened position and a closed position to press a flexible printed board against the contacts, a first metallic reinforcement which is partially embedded in the cover during the molding of the cover, a second metallic reinforcement means fixed to the housing, and a third reinforcement which comprises a metallic wire partially embody in the cover during the molding thereof, the first and second reinforcements constituting a locking mechanism, that locks the cover in the closed position, and that includes a first and a second engagement portion at opposite ends thereon which releasably engage with each other.

28. A connector according to claim 27, wherein the first reinforcement includes a pair of opposite ends which are exposed from the cover and each of which comprises the first engagement portion.

29. A connector according to claim 28, wherein the second reinforcement comprises a pair of reinforcing plates, each reinforcing plate including:

a main body fixed to the housing; and the second engagement portion which engages the first engagement portion provided at each of the opposite ends of the first reinforcement.

30. A connector according to claim 27, further comprising a pair of pivot shafts provided respectively at a pair of lateral side portions of the cover and being aligned with the axis, the second reinforcement including support portions for supporting the pivot shafts.

31. A connector according to claim 27, wherein the pair of pivot shafts are respectively provided at a pair of opposite ends of the third reinforcement.

32. A connector according to claim 28, wherein the first reinforcement further includes at least one exposure portion exposed from the cover at an intermediate portion between a pair of lateral side portions thereof, wherein the second reinforcement comprises at least three reinforcing plates which are respectively disposed in correspondence with the pair of opposite ends and at least one exposure portion, and wherein each of the reinforcing plates has a main body fixed to the housing and the second engagement portion.

33. A connector according to claim 27, wherein the first, second and third reinforcements form a closed loop when the cover is in the closed position.

34. A connector according to claim 27, wherein a pair of opposite ends of the third reinforcement are respectively disposed at a pair of lateral side portions of the cover and comprise a pair of pivot shafts aligned with the axis, wherein the pair of opposite ends of the first reinforcement are respectively exposed from corresponding lateral side portions of the cover, and wherein the second reinforcement includes a pair of reinforcing plates, each of the reinforcing plates including the second engagement portion to engage the corresponding first engagement portion, and a support portion for supporting a corresponding pivot shaft.

35. A connector according to claim 34, wherein when the cover is in the closed position, a pair of opposite ends of the first reinforcement are coupled with the pair of opposite ends of the third reinforcement by the corresponding reinforcing plates whereby a substantially rectangular closed loop is formed by the first and third reinforcement and the pair of reinforcing plates.

36. A connector according to claim 27, further comprising a pair of pivot shafts provided at a pair of lateral side portions of the cover as aligned with the axis, wherein the second reinforcement comprises a pair of reinforcement plates, wherein each of the reinforcing plates includes a main body fixed to the housing and a substantially L-shaped extension piece extended from the main body, and wherein the main body and the substantially L-shaped extension piece define a notch for supporting the corresponding pivot shaft of the cover.

37. A connector according to claim 27, further comprising a pair of pivot shafts respectively provided at a pair of lateral side portions of the cover as aligned with the axis, wherein the second reinforcement comprises a pair of reinforcement plates, and wherein each of the reinforcing plates includes a main body fixed to the housing and a straight extension piece substantially orthogonally extending from the main body, the straight extension piece preventing the corresponding pivot shaft of the cover from being dislocated in a direction corresponding to drawing out the flexible board from said housing.

38. A connector according to claim 27, wherein the first reinforcement comprises a wire.

* * * * *